US007721702B2

(12) United States Patent
Miller et al.

(10) Patent No.: US 7,721,702 B2
(45) Date of Patent: May 25, 2010

(54) SPARK PLUG HAVING SEPARATE HOUSING-MOUNTED ELECTRODE

(75) Inventors: Robert L. Miller, Dunlap, IL (US); Thomas Randall McClure, Washington, IL (US); Kevin James Karkkainen, Washington, IL (US); Robert Matthew Lucas, Spring Valley, IL (US)

(73) Assignee: Caterpillar Inc., Peoria, IL (US)

( * ) Notice: Subject to any disclaimer, the term of this patent is extended or adjusted under 35 U.S.C. 154(b) by 937 days.

(21) Appl. No.: 11/513,285

(22) Filed: Aug. 31, 2006

(65) Prior Publication Data

US 2008/0053072 A1 Mar. 6, 2008

(51) Int. Cl.
*F01N 3/00* (2006.01)
*H01T 13/20* (2006.01)

(52) U.S. Cl. ..... 123/298; 123/169 EL; 313/143

(58) Field of Classification Search ..... 123/298, 123/169 E, 169 EL, 169 R, 169 PH; 313/141, 313/143

See application file for complete search history.

(56) References Cited

U.S. PATENT DOCUMENTS

| | | | | |
|---|---|---|---|---|
| 2,031,293 | A | | 2/1936 | Wamelink |
| 3,383,854 | A | | 5/1968 | White |
| 3,742,682 | A | | 7/1973 | Ligutom |
| 3,957,467 | A | | 5/1976 | Kim |
| 4,300,924 | A | | 11/1981 | Coyle |
| H172 | H | | 12/1986 | Pribyl et al |
| 4,719,751 | A | | 1/1988 | Kume et al. |
| 4,805,570 | A | | 2/1989 | Davis |
| 4,987,738 | A | | 1/1991 | Lopez-Crevillen et al. |
| 5,014,656 | A | * | 5/1991 | Leptich et al. ..... 123/169 EL |
| 5,095,694 | A | | 3/1992 | Shekleton et al. |
| 5,127,840 | A | * | 7/1992 | Bezusko et al. ..... 123/169 PH |
| 5,243,816 | A | | 9/1993 | Huddas |
| 6,032,462 | A | | 3/2000 | Chu |
| 6,050,081 | A | | 4/2000 | Jansen et al. |
| 6,438,963 | B1 | | 8/2002 | Traver et al. |
| 6,536,217 | B2 | | 3/2003 | Lipinski et al. |
| 6,931,831 | B2 | | 8/2005 | Jansen |
| 2004/0020193 | A1 | | 2/2004 | Miebach |
| 2005/0150220 | A1 | | 7/2005 | Johnson et al. |

FOREIGN PATENT DOCUMENTS

| | | |
|---|---|---|
| DE | 889532 | 9/1953 |
| DE | 19711876 | 10/1997 |

(Continued)

OTHER PUBLICATIONS

PCT International Search Report; Applicant's Ref. No. 06-654; PCT/US2007/017090; Filing Date: Jul. 31, 2007; Caterpillar Inc.

(Continued)

*Primary Examiner*—Hieu T Vo
(74) *Attorney, Agent, or Firm*—Finnegan, Henderson, Farabow, Garrett & Dunner

(57) ABSTRACT

A spark plug arrangement for an exhaust treatment device is disclosed. The spark plug arrangement may have a body, and a center electrode extending from an end of the body. The spark plug arrangement may further have a mounting member with a bore configured to receive the body, and a grounded electrode extending proximal the center electrode.

24 Claims, 2 Drawing Sheets

FOREIGN PATENT DOCUMENTS

| | | | |
|---|---|---|---|
| EP | 1 336 729 | | 8/2003 |
| FR | 621203 | | 5/1927 |
| JP | 2005-48656 A | * | 2/2005 |
| WO | WO 00/73650 | | 12/2000 |

OTHER PUBLICATIONS

Harmon et al., U.S. Appl. No. 11/170,318, filed Jun. 30, 2005, entitled "Regeneration Assembly,".

Miller et al., U.S. Appl. No. 11/503,305, filed Aug. 14, 2006, entitled "Fuel Supply Component Purging System,".

Karkkainen et al., U.S. Appl. No. 11/503,306, filed Aug. 14, 2006, entitled "Fuel Supply Component Cleaning System,".

* cited by examiner

SPARK PLUG HAVING SEPARATE HOUSING-MOUNTED ELECTRODE

TECHNICAL FIELD

The present disclosure is directed to a spark plug and, more particularly, to a spark plug having a grounded electrode that is separate from the spark plug and mounted to a housing member that receives the spark plug. Background Engines, including diesel engines, gasoline engines, gaseous fuel powered engines, and other engines known in the art ignite injections of fuel to produce heat. The heat from this process may be converted to mechanical and electrical power, or used to increase the temperature of particular engine components. For example, fuel may be injected into a combustion chamber of an engine and ignited by way of a spark plug. The heat and expanding gases resulting from this combustion may be directed to displace a piston or move a turbine blade, both of which can be connected to a crankshaft of the engine. As the piston is displaced or the turbine blade is moved, the crankshaft is caused to rotate. This rotation may be directly utilized to drive a device such as a transmission to propel a vehicle, or a generator to produce electrical power. In another example, the fuel may additionally or alternatively be injected into an exhaust stream and ignited by way of the spark plug. The heat resulting from this combustion may be directed to a particulate laden filtration medium to regenerate the medium, or directed to a catalytic device to improve the operating efficiency of the device.

In any of the examples described above, the geometry and orientation of the spark plug relative to the injection of fuel can affect the operation of the associated engine. In particular, if the spark plug geometry and/or orientation are such that an arc is produced at a desired location relative to the injection of fuel, efficient and timely combustion may occur. However, if the spark plug geometry and orientation are such that the arc is produced at an undesired location or the injection of fuel is interrupted or blocked by the spark plug, combustion may occur at an undesired location or timing, or possibly not at all.

An example of injecting fuel and igniting the injected fuel with a spark plug is described in U.S. Pat. No. 4,987,738 (the '738 patent) issued to Lopez-Crevillen et al. on Jan. 29, 1991. Specifically, the '738 patent discloses a particulate filter having a burner used to incinerate trapped particulates. The burner includes a fuel injector nozzle for injecting fuel into the burner during regeneration. As the fuel, under pressure, is injected by the nozzle into the burner apparatus, it is atomized by high pressure air. An igniter included within the burner is energized to ignite the air-fuel mixture, and the burning mixture is combined with metered exhaust gas. As illustrated in FIG. 1 of the '738 patent, the igniter includes a typical spark plug having a center electrode and a grounded electrode attached to one side of the spark plug.

Although the injector nozzle and igniter configuration of the '738 patent may be suitable in some situations, it may be prone to improper assembly resulting in poor operation of the burner. Specifically, because the ground electrode is attached to one side of the igniter (i.e., the spark plug), an incorrect orientation of the spark plug such as the spark plug being turned to an excessive or insufficient angle could allow the ground electrode to block fuel spray from the injector nozzle. The blockage of fuel spray could adversely effect the resulting combustion.

Further, the injector nozzle and igniter configuration of the '738 patent may also be unreliable and prone to unintentional arcing. That is, because the ground electrode is attached to the spark plug and because of space constraints within the burner, the ground electrode may have a relatively small cross section. The small cross section coupled with a large cantilevered distance (i.e., the distance the ground electrode extends from the spark plug) could result in vibration being induced within the ground electrode. This vibration, if significant, could result in damage to the ground electrode and/or unintentional arcing along the length of the ground electrode instead of at the tip of the ground electrode. Further, during operation of the burner, it may be possible for carbon, foreign material, or debris to fill the space between the ground and center electrodes. Without a way to remove this debris, unintentional arcing may occur.

The spark plug of the present disclosure solves one or more of the problems set forth above.

SUMMARY OF THE INVENTION

One aspect of the present disclosure is directed to a spark plug arrangement. The spark plug arrangement may include a body, and a center electrode extending from an end of the body. The spark plug arrangement may further include a mounting member with a bore configured to receive the body, and a grounded electrode extending proximal the center electrode.

Another aspect of the present disclosure is directed to a spark plug for use with a mounting member having a grounded electrode. The spark plug may include a body configured for insertion into the mounting member. The spark plug may also include only a positive electrode configured to mate with the grounded electrode.

Yet another aspect of the present disclosure is directed to a method of igniting fuel. The method may include injecting fuel into a chamber, and directing air into the chamber. The method may also include grounding a portion of the chamber, and directing current to an electrode to cause an arc between the electrode and the grounded portion of the chamber.

DETAILED DESCRIPTION

Figure 1:
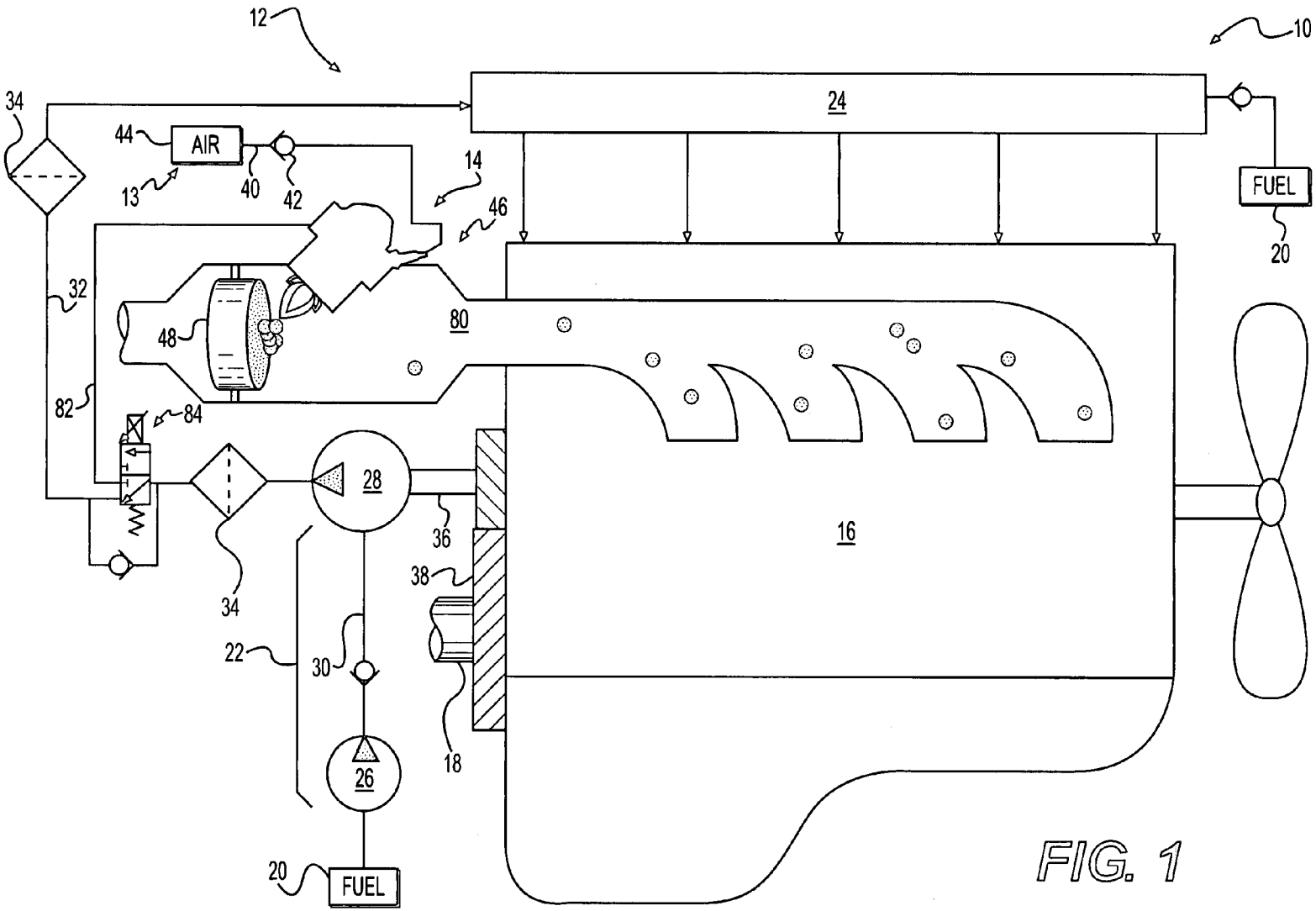
FIG. 1 is a schematic and diagrammatic illustration of an exemplary disclosed power unit.

FIG. 1 illustrates a power unit 10 having a common rail fuel system 12, a purge system 13, and an auxiliary regeneration system 14. For the purposes of this disclosure, power unit 10 is depicted and described as a four-stroke diesel engine. One skilled in the art will recognize, however, that power unit 10 may be any other type of internal combustion engine such as, for example, a gasoline or a gaseous fuel-powered engine. Power unit 10 may include an engine block 16 that at least partially defines a plurality of combustion chambers (not shown). In the illustrated embodiment, power unit 10 includes four combustion chambers. However, it is contemplated that power unit 10 may include a greater or lesser number of combustion chambers and that the combustion chambers may be disposed in an "in-line" configuration, a "V" configuration, or any other suitable configuration.

As also shown in FIG. 1, power unit 10 may include a crankshaft 18 that is rotatably disposed within engine block 16. A connecting rod (not shown) may connect a plurality of pistons (not shown) to crankshaft 18 so that a sliding motion of each piston within the respective combustion chamber results in a rotation of crankshaft 18. Similarly, a rotation of crankshaft 18 may result in a sliding motion of the pistons.

Common rail fuel system 12 may include components that cooperate to deliver injections of pressurized fuel into each of the combustion chambers. Specifically, common rail fuel system 12 may include a tank 20 configured to hold a supply of fuel, and a fuel pumping arrangement 22 configured to pressurize the fuel and direct the pressurized fuel to a plurality of fuel injectors (not shown) by way of a common rail 24.

Fuel pumping arrangement 22 may include one or more pumping devices that function to increase the pressure of the fuel and direct one or more pressurized streams of fuel to common rail 24. In one example, fuel pumping arrangement 22 includes a low pressure source 26 and a high pressure source 28 disposed in series and fluidly connected by way of a fuel line 30. Low pressure source 26 may embody a transfer pump that provides low pressure feed to high pressure source 28. High pressure source 28 may receive the low pressure feed and increase the pressure of the fuel to the range of about 30-300 MPa. High pressure source 28 may be connected to common rail 24 by way of a fuel line 32. One or more filtering elements 34, such as a primary filter and a secondary filter, may be disposed within fuel line 32 in series relation to remove debris and/or water from the fuel pressurized by fuel pumping arrangement 22.

One or both of low and high pressure sources 26, 28 may be operably connected to power unit 10 and driven by crankshaft 18. Low and/or high pressure sources 26, 28 may be connected with crankshaft 18 in any manner readily apparent to one skilled in the art where a rotation of crankshaft 18 will result in a corresponding driving rotation of a pump shaft. For example, a pump driveshaft 36 of high pressure source 28 is shown in FIG. 1 as being connected to crankshaft 18 through a gear train 38. It is contemplated, however, that one or both of low and high pressure sources 26, 28 may alternatively be driven electrically, hydraulically, pneumatically, or in any other appropriate manner. It is further contemplated that common rail fuel system 12 may alternatively embody another type of fuel system such as, for example, mechanical unit fuel injector systems where the pressure of the injected fuel is generated or enhanced within the individual injectors without the use of a high pressure source.

Purge system 13 may pressurize a gas and provide this pressurized gas to auxiliary regeneration system 14 for purging and/or combustion purposes. For example, a gas such as compressed air may be directed to auxiliary regeneration system 14 to purge components thereof of residual fuel and/or contaminates. Alternatively or additionally, this purge gas may be directed to mix with fuel and, thereby, aid combustion within auxiliary regeneration system 14. For these purposes, purge system 13 may include a gas source 44 such as, for example, a compressor, an air pump, or any other suitable source, and a storage reservoir, such as a tank or an accumulator having sufficient volume to complete a purging and/or combusting process with or without operation of gas source 44. A purge passageway 40 may fluidly connect the components of auxiliary regeneration system 14 to gas source 44 at any upstream location. A check valve 42 may be disposed within purge passageway 40 to ensure that fuel and other contaminates are blocked from flowing through purge passageway 40 to gas source 44. The flow of purge gas through purge passageway 40 may be controlled by way of a suitable valve arrangement (not shown).

Auxiliary regeneration system 14 may be associated with an exhaust treatment device 46. In particular, as exhaust from power unit 10 flows through exhaust treatment device 46, particulate matter may be removed from the exhaust flow by wire mesh or ceramic honeycomb filtration media 48. Over time, the particulate matter may build up in filtration media 48 and, if left unchecked, the particulate matter buildup could be significant enough to restrict, or even block the flow of exhaust through exhaust treatment device 46, allowing for backpressure within the power unit 10 to increase. An increase in the backpressure of power unit 10 could reduce the power unit's ability to draw in fresh air, resulting in decreased performance, increased exhaust temperatures, and poor fuel consumption.

Figure 2B:
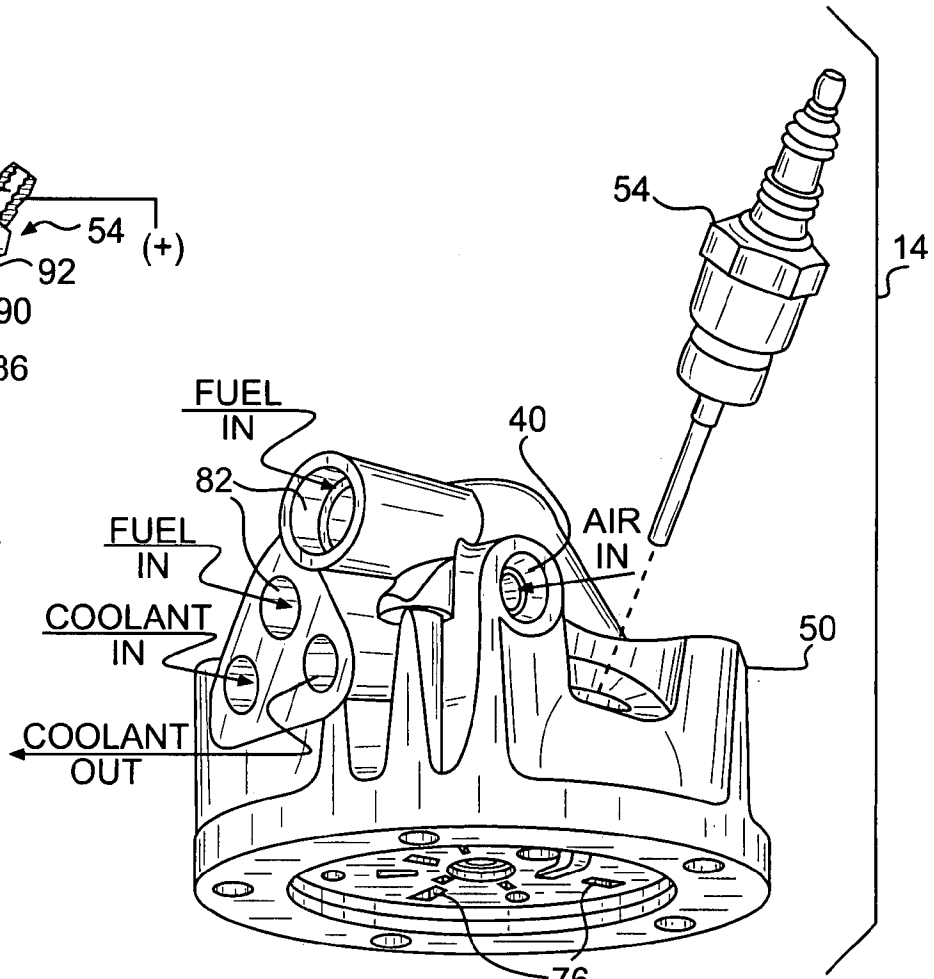
FIG. 2B is pictorial view of the regeneration device of FIG. 2A.
Figure 2A:
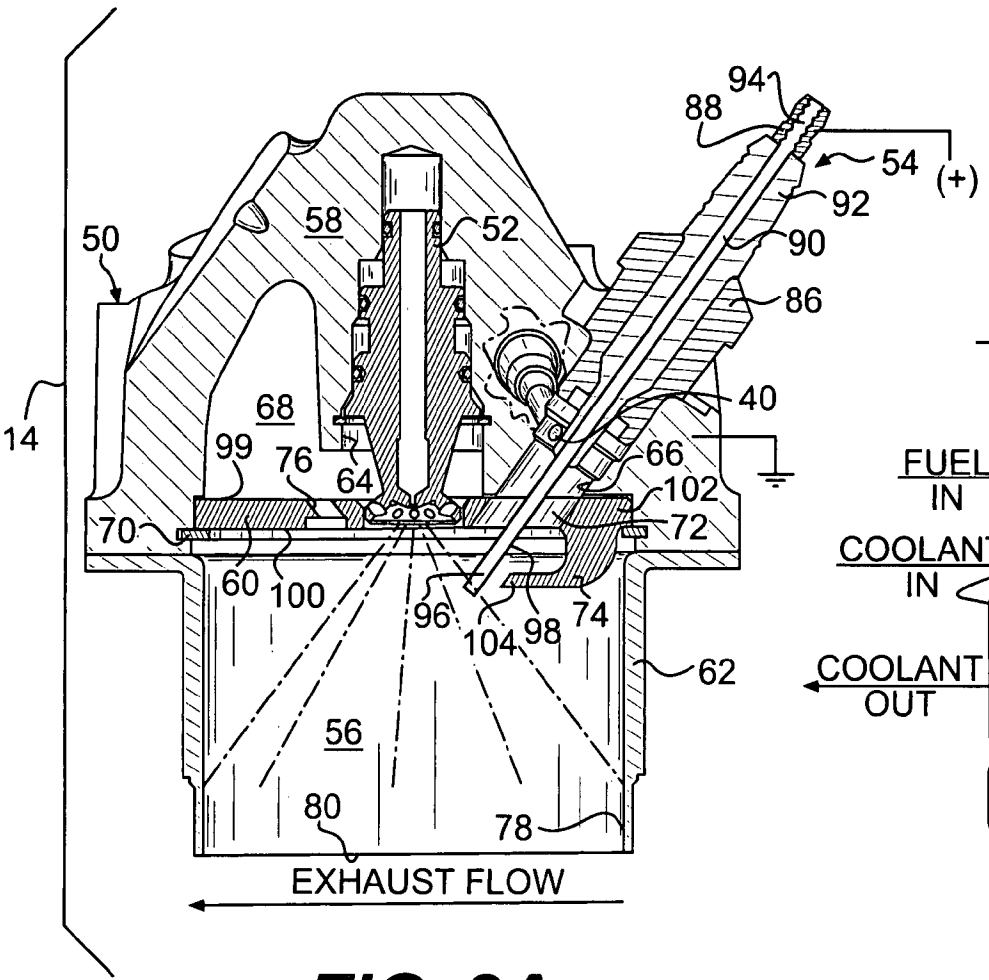
FIG. 2A is a cross-sectional illustration an exemplary disclosed regeneration device for use with the power unit of FIG. 1.

As illustrated in FIGS. 2A and 2B, auxiliary regeneration system 14 may include components that cooperate to periodically reduce the buildup of particulate matter within filtration media 48. These components may include a housing 50, an injector 52, and a spark plug 54. It is contemplated that auxiliary regeneration system 14 may include additional or different components such as, for example, one or more pilot injectors, additional main injectors, a controller, a pressure sensor, a temperature sensor, a flow sensor, a flow blocking device, and other components known in the art.

Housing 50 may be an assembly of components that, together, form a combustion chamber 56. In particular, housing 50 may include a mounting element 58, a swirler plate 60, and a can 62. Swirler plate 60 may be received within mounting element 58, while can 62 may be connected to a bottom portion of mounting element 58.

Mounting element 58 may receive and fluidly connect fuel injector 52 and spark plug 54 with fuel, air, and coolant. In particular, mounting element 58 may be formed in or connected to an outer wall portion of exhaust treatment device 46, and include a stepped bore 64 for receiving fuel injector 52, and a stepped bore 66 for receiving spark plug 54. Stepped bore 64 may be in communication with common rail fuel system 12 to communicate fuel injector 52 with the pressurized fuel of pumping arrangement 22, with the compressed air of gas source 44, and/or with the heat transferring medium of a coolant system (not shown). Each of these systems may have passages that open into stepped bore 64 at different axial locations to communicate their respective fluids therewith. Stepped bore 66 may be in communication with purge system 13 via purge passageway 40.

Swirler plate 60 may be situated to conduct an electrical current to mounting element 58. That is, swirler plate 60 may be fabricated from an electrical conducting material such as, for example, a stainless steel, and press-fitted into a recess of mounting element 58. Swirler plate 60, together with mounting element 58, may form an air chamber 68, which may be supplied with compressed air from purge system 13. It is contemplated that swirler plate 60 may additionally or alternatively be connected to mounting element 58 by way of a snap-ring 70, a threaded fastener (not shown), welding, or in any other manner known in the art, if desired.

Swirler plate 60 may include a through hole 72, a grounded electrode 74, and a plurality of annularly disposed air vents 76. Grounded electrode 74 may be located at a periphery of through hole 72 to interact with spark plug 54. Air vents 76 may mix air from purge system 13 with injections of fuel inside can 62. The mixing of air and fuel within can 62 may improve combustion. It is contemplated that air vents 76 may additionally or alternatively be directed to the outer periphery of can 62 for cooling and/or insulating purposes, if desired.

Can 62 may embody a tubular member configured to axially direct an ignited fuel/air mixture from auxiliary regeneration device 14 into the exhaust flow of treatment device 46. In particular, can 62 may include a central opening 78 that fluidly communicates fuel from fuel injector 52 and air from chamber 68 with the exhaust flow. Can 62 may be generally straight and may have a predetermined length set during manufacture according to a desired flame introduction location (the distance that a flame resulting from the ignition of the fuel/air mixture extends from can 62 into the exhaust flow). In one example, this desired introduction location may be about 12 inches from an outlet 80 of can 62.

Injector 52 may be disposed within mounting element 58 and connected to fuel line 32 by way of a fuel passageway 82 and a main control valve 84 (referring to FIG. 1). Injector 52 may be operable to inject an amount of pressurized fuel into can 62 at predetermined timings, fuel pressures, and fuel flow rates. The timing of fuel injection into can 62 may be synchronized with sensory input received from a temperature sensor (not shown), one or more pressure sensors (not shown), a timer (not shown), or any other similar sensory devices such that the injections of fuel substantially correspond with a buildup of particulate matter within filtration media 48. For example, fuel may be injected as a pressure of the exhaust flowing through exhaust treatment device 46 exceeds a predetermined pressure level or a pressure drop across filtration media 48 exceeds a predetermined differential value. Alternatively or additionally, fuel may be injected as the temperature of the exhaust flowing through exhaust treatment device 46 exceeds a predetermined value. It is contemplated that fuel may also be injected on a set periodic basis, in addition to or regardless of pressure and temperature conditions, if desired.

Main control valve 84 (referring to FIG. 1) may include an electronically controlled valve element that is solenoid movable against a spring bias in response to a commanded flow rate from a first position at which pressurized fuel may be directed to common rail 24, to a second position at which fuel may be directed to auxiliary regeneration system 14. It is contemplated that main control valve 84 may alternatively be hydraulically or pneumatically actuated in an indirect manner, if desired.

Spark plug 54 may facilitate ignition of fuel sprayed from injector 52 into can 62 during a regeneration event. Specifically, during a regeneration event, the temperature of the exhaust exiting power unit 10 may be too low to cause autoignition of the particulate matter trapped within exhaust treatment device 46 or of the fuel sprayed from injector 52. To initiate combustion of the fuel and, subsequently, the trapped particulate matter, a small quantity (i.e., a pilot shot) of fuel from injector 52 may be sprayed or otherwise injected toward the space between spark plug 54 and grounded electrode 74 to create a locally rich atmosphere readily ignitable by spark plug 54. A spark developed across electrode of spark plug 54 and grounded electrode 74 may ignite the locally rich atmosphere creating a flame, which may be jetted or otherwise advanced toward the trapped particulate matter. The flame jet propagating from injector 52 may raise the temperature within exhaust treatment device 46 to a level that readily supports efficient ignition of a larger quantity (i.e., a main shot) of fuel from injector 52. As the main injection of fuel ignites, the temperature within exhaust treatment device 46 may continue to rise to a level that causes ignition of the particulate matter trapped within filtration media 48, thereby regenerating exhaust treatment device 46.

Spark plug 54 may include multiple components that cooperate to ignite the fuel sprayed from injector 52. In particular, spark plug 54 may include a body 86, a terminal 88 extending from one end of body 86, and a center electrode 90 extending from an opposing second end of body 86. Body 86 may be threadingly received within stepped bore 66, and separated from center electrode. 90 by an insulating element 92. Center electrode 90 may be electrically connected to terminal 88. It is contemplated that terminal 88 may alternatively be integral with center electrode 90 or omitted, if desired.

An electrical arc may be generated between center electrode 90 and grounded electrode 74. That is, center electrode 90 may have a base end 94 operatively fixed to body 86, a free tip end 96, and a side portion 98 extending from base end 94 to free tip end 96. When spark plug 54 is assembled within housing 50, the free tip end 96 may extend from a first surface 99 of swirler plate 60 through hole 72 past a second surface 100 of swirler plate 60. Grounded electrode 74 may have a base end 102 connected to the second surface 100 of swirler plate 60 (i.e., integrally formed with swirler plate 60), and a free tip end 104. The free tip end 104 of grounded electrode 74 may extend toward the side portion 98 of center electrode 90, and terminate at a radial position between the base end 102 and the side portion 98. The distance between the free tip end 96 and the free tip end 104 may be designed such that, when a charge is directed through terminal 88 to center electrode 90, an arc may form from the free tip end 96 to the free tip end 104 of grounded electrode 74. This arc may facilitate ignition of the fuel/air mixture within can 62.

INDUSTRIAL APPLICABILITY

The spark plug arrangement of the present disclosure may be applicable to a variety of exhaust treatment devices including, for example, particulate regeneration devices and catalytic warming devices that utilize a spark to ignite a fuel flow. In fact, the disclosed spark arrangement may even be implemented into the primary combustion chambers of an engine to ignite the fuel injected during the typical power-generating cycle. The disclosed spark arrangement may ensure optimal combustion of the fuel flow by minimizing the likelihood of fuel spray blockage and unintentional arcing, while protecting the spark arrangement from residual fuel and contamination. The operation of power unit 10 will now be explained.

Referring to FIG. 1, air and fuel may be drawn into the combustion chambers of power unit 10 for subsequent combustion. Specifically, fuel from common rail fuel system 12 may be injected into the combustion chambers of power unit 10, mixed with the air therein, and combusted by power unit 10 to produce a mechanical work output and an exhaust flow of hot gases. The exhaust flow may contain a complex mixture of air pollutants composed of gaseous and solid material, which can include particulate matter. As this particulate laden exhaust flow is directed from the combustion chambers through exhaust treatment device 46, particulate matter may be strained from the exhaust flow by filtration media 48. Over time, the particulate matter may build up in filtration media 48 and, if left unchecked, the buildup could be significant enough to restrict, or even block the flow of exhaust through exhaust treatment device 46. As indicated above, the restriction of exhaust flow from power unit 10 may increase the backpressure of power unit 10 and reduce the unit's ability to draw in fresh air, resulting in decreased performance of power unit 10, increased exhaust temperatures, and poor fuel consumption.

To prevent the undesired buildup of particulate matter within exhaust treatment device 46, filtration media 48 may be regenerated. Regeneration may be periodic or based on a triggering condition such as, for example, a lapsed time of engine operation, a pressure differential measured across filtration media 48, a temperature of the exhaust flowing from power unit 10, or any other condition known in the art.

As illustrated in FIG. 2, to initiate regeneration, injector 52 may be caused to selectively pass fuel into exhaust treatment device 46 at a desired rate, pressure, and/or timing. As an injection of fuel from injector 52 sprays into exhaust treatment device 46, air may be mixed with the fuel via the air vents 76 of swirler plate 60. As this fuel/air mixture swirls into combustion chamber 56 of can 62, a current may be directed to center electrode 90 via terminal 88. As the current builds within center electrode 90, an arc may form from free tip end 96 of center electrode 90 to free tip end 104 of grounded electrode 74, thereby igniting the mixture. The ignited flow of fuel and air may then raise the temperature of the particulate matter trapped within filtration media 48 to the combustion level of the entrapped particulate matter, burning away the particulate matter and, thereby, regenerating filtration media 48.

Between and/or during regeneration events, spark plug 54 may be selectively purged of fuel and/or contaminates to ensure proper operation of spark plug 54. To purge spark plug 54, purge gas from source 44 may be directed through purge passageway 40, past check valve 42, through stepped bore 66. The purge gas flowing into stepped bore 66 may force any remaining fuel within this bore out into combustion chamber 56. By removing the fuel and/or contaminates from stepped bore 66, the likelihood of arcing at a point other than the free tip end 94 of center electrode 90 may be ensured.

Because grounded electrode 74 may be attached to housing 50, proper orientation of spark plug 54 may be ensured. That is, because the orientation of grounded electrode 74 is independent of the angular engagement of spark plug 54 with stepped bore 66, it may be ensured that grounded electrode 74 is always correctly oriented with respect to fuel injector 52, regardless of the angular orientation of spark plug 54. This correct orientation may minimize the likelihood of grounded electrode 74 undesirably blocking fuel spray from fuel injector 52, and center electrode 90 may always be positioned-correctly between fuel injector 52 and grounded electrode 74.

In addition, because grounded electrode 74 may extend from housing 50 (i.e., from swirler plate 60), the likelihood of unintentional arcing may be minimized. Specifically, because grounded electrode 74 may extend from swirler plate 60, its cantilevered distance may be short. This short cantilevered distance may minimize the amplitude of vibration induced within grounded electrode 74. By minimizing the induced amplitude vibration, the proper distance between center electrode 90 and grounded electrode 74 may be consistently maintained, thereby minimizing the likelihood of arcing at a point other that the free tip end 96 of center electrode 90, the likelihood of arcing with an improper current, and/or arcing at an improper timing. Further, the minimized vibration amplitude may correspond with an increased component life of grounded electrode 74. The increased cross-section of grounded electrode 74 afforded by its connection to swirler plate 60 may further help to reduce the amplitude of vibrations induced therein.

It will be apparent to those skilled in the art that various modifications and variations can be made to the spark plug arrangement of the present disclosure without departing from the scope of the disclosure. Other embodiments will be apparent to those skilled in the art from consideration of the specification and practice of the spark plug arrangement disclosed herein. It is intended that the specification and examples be considered as exemplary only, with a true scope of the disclosure being indicated by the following claims and their equivalents.

What is claimed is:

1. A spark plug for use with a mounting member having a grounded electrode, the spark plug comprising:

a body configured for insertion into the mounting member; and only a positive electrode configured to mate with the grounded electrode, wherein the positive electrode extends from the body past the grounded electrode.

2. The spark plug of claim 1, wherein the positive electrode extends from and is axially aligned with the body.

3. The spark plug of claim 2, further including a terminal electrically connected to the positive electrode and extending from the body opposite the positive electrode.

4. The spark plug of claim 1, wherein the positive electrode is electrically insulated from the body.

5. A spark plug arrangement, comprising:

a body;

a center electrode extending from an end of the body;

a mounting member including a bore configured to receive the body; and a grounded electrode connected to the mounting member, and having a proximal end portion and a distal end portion, the distal end portion including a distal tip extending toward the center electrode.

6. The spark plug arrangement of claim 5, wherein the body is threadingly received within the bore.

7. The spark plug arrangement of claim 5, wherein the center electrode is insulated from the mounting member.

8. The spark plug arrangement of claim 5, further including a plate press-fit into an open end of the mounting member to close off a cavity within the mounting member, wherein the grounded electrode is integral with the plate.

9. The spark plug arrangement of claim 8, wherein the plate is a swirler plate configured to mix fuel and air.

10. The spark plug arrangement of claim 9, wherein the center electrode extends through the swirler plate from a first surface past a second opposing surface.

11. The spark plug arrangement of claim 10, wherein the grounded electrode extends from the second surface of the swirler plate.

12. The spark plug arrangement of claim 8, wherein the first mounting element includes a purge gas line in communication with the bore.

13. The spark plug arrangement of claim 8, wherein:

the center electrode has a base end fixed to the body, a free tip end, and a side portion extending from the base end to the free tip end; and the distal tip of the grounded electrode is angled toward the side portion of the center electrode and terminates at a radial location between the proximal end portion of the grounded electrode and a base end of the center electrode.

14. The spark plug arrangement of claim 5, wherein the spark plug arrangement is associated with a fuel injector and the grounded electrode is always maintained in the same orientation relative to the fuel injector when the spark plug arrangement is assembled.

15. The spark plug arrangement of claim 14, wherein the center electrode is always maintained in position between the grounded electrode and the fuel injector when the spark plug arrangement is assembled.

16. An exhaust treatment device, comprising:

a housing configured to receive a flow of exhaust and having an opening;

a mounting member configured to close off the opening and including:

a first bore; and a second bore;

a grounded electrode extending from a periphery of the second bore;

a fuel injector disposed within the first bore to selectively inject fuel into the flow of exhaust; and a spark plug configured to ignite the injected fuel, the spark plug including:

a body disposed within the second bore;

a terminal extending from a first end of the body; and a center electrode connected to the terminal and extending from an opposing second end of the body.

17. The exhaust treatment device of claim 16, further including a swirler plate press-fit into the mounting member, wherein the grounded electrode is integral with the swirler plate.

18. The exhaust treatment device of claim 17, wherein the swirler plate is configured to mix the injected fuel with air.

19. The exhaust treatment device of claim 17, wherein:

the grounded electrode has a base end at the swirler plate, and a free tip end;

the center electrode has a base end fixed to the body, a free tip end, and a side portion extending from the base end to the free tip end; and the free tip end of the grounded electrode is angled toward the side portion of the center electrode and terminates at a radial location between the base end of the grounded electrode and a base end of the center electrode.

20. The exhaust treatment device of claim 16, wherein the mounting member includes a purge gas line in communication with the second bore.

21. The exhaust treatment device of claim 16, wherein:

the grounded electrode is always maintained in the same orientation relative to the fuel injector when the spark plug is assembled to the mounting member; and the center electrode is always maintained in position between the grounded electrode and the fuel injector when the spark plug is assembled to the mounting member.

22. A method of igniting fuel, comprising:

injecting fuel into a chamber;

directing air into the chamber;

grounding a portion of the chamber;

directing current to an electrode to cause an arc between the electrode and the grounded portion of the chamber; and mixing the fuel and air with the grounded portion of the chamber.

23. The method of claim 22, further including selectively directing purge gas toward the electrode.

24. The method of claim 22, wherein the arc always propagates in a direction away from the injection of fuel.

* * * * *